US006702905B1

(12) United States Patent
Qiao et al.

(10) Patent No.: US 6,702,905 B1
(45) Date of Patent: Mar. 9, 2004

(54) CORROSION AND WEAR RESISTANT ALLOY

(75) Inventors: Cong Yue Qiao, Menominee, MI (US); Todd Trudeau, Menominee, MI (US)

(73) Assignee: L. E. Jones Company, Menominee, MI (US)

( * ) Notice: Subject to any disclaimer, the term of this patent is extended or adjusted under 35 U.S.C. 154(b) by 0 days.

(21) Appl. No.: 10/352,917

(22) Filed: Jan. 29, 2003

(51) Int. Cl.[7] ..... C21D 9/00; C22C 38/22; C22C 38/24; C22C 38/26

(52) U.S. Cl. ..... 148/326; 148/328; 148/330; 148/334; 148/543; 148/545; 148/548; 148/663; 75/236

(58) Field of Search ..... 148/324, 326, 148/328, 330, 663, 334, 543, 545, 548; 420/12, 101, 102; 75/236, 246; 123/188.5, 188.8

(56) References Cited

U.S. PATENT DOCUMENTS

| | | | | |
|---|---|---|---|---|
| 2,064,155 | A | | 12/1936 | Fahrenwald |
| 2,147,122 | A | | 2/1939 | Emmons |
| 3,694,173 | A | | 9/1972 | Farmer et al. |
| 4,035,159 | A | | 7/1977 | Hashimoto et al. |
| 4,116,684 | A | | 9/1978 | Uchida et al. |
| 4,546,737 | A | | 10/1985 | Kazuoka et al. |
| 4,724,000 | A | | 2/1988 | Larson et al. |
| 4,970,049 | A | | 11/1990 | Baker et al. |
| 5,188,659 | A | | 2/1993 | Purnell |
| 5,312,475 | A | | 5/1994 | Purnell et al. |
| 5,462,573 | A | | 10/1995 | Baker et al. |
| 5,666,632 | A | | 9/1997 | Maulik |
| 5,674,449 | A | | 10/1997 | Liang et al. |
| 5,784,681 | A | | 7/1998 | Purnell et al. |
| 5,859,376 | A | | 1/1999 | Ishibashi et al. |
| 5,870,989 | A | * | 2/1999 | Takahashi et al. ..... 75/246 |
| 5,949,003 | A | | 9/1999 | Aoki et al. |
| 6,138,351 | A | | 10/2000 | Adachi et al. |
| 6,139,598 | A | | 10/2000 | Narasimhan et al. |
| 6,200,688 | B1 | | 3/2001 | Liang et al. |
| 6,214,080 | B1 | | 4/2001 | Narasimhan et al. |
| 6,340,377 | B1 | | 1/2002 | Kawata et al. |

FOREIGN PATENT DOCUMENTS

| | | |
|---|---|---|
| FR | 1356541 | 2/1964 |
| JP | 57-073172 | 5/1982 |
| JP | 58-058254 | 4/1983 |
| JP | 09-209095 | 8/1997 |

* cited by examiner

*Primary Examiner*—Deborah Yee
(74) *Attorney, Agent, or Firm*—Burns, Doane, Swecker & Mathis, LLP

(57) ABSTRACT

An iron-based corrosion resistant and wear resistant alloy. The alloy can comprise (in weight percent) 0.005–0.5% boron, 1.2–1.8% carbon, 0.7–1.5% vanadium, 7–11% chromium, 1–3.5% niobium, 6–11% molybdenum, and the balance including iron and incidental impurities. Alternatively, the Nb content can be replaced or combined with Ti, Zr, Hf and/or Ta such that 1%<(Ti+Zr+Nb+Hf+Ta) ≦3.5. The alloy has improved hot hardness and high temperature compressive strength and is suitable for use in elevated temperature applications such as in diesel valve seat inserts.

36 Claims, 3 Drawing Sheets

CORROSION AND WEAR RESISTANT ALLOY

FIELD OF THE INVENTION

The present invention relates to a high temperature, corrosion and wear resistant iron-based alloy, and particularly to an alloy for use in valve seat inserts.

BACKGROUND OF THE INVENTION

More restrictive exhaust emissions laws for diesel engines have driven changes in engine design including the need for high-pressure electronic fuel injection systems. Engines built according to the new designs use higher combustion pressures, higher operating temperatures and less lubrication than previous designs. Components of the new designs, including valve seat inserts (VSI), have experienced significantly higher wear rates. Exhaust valve seat inserts and valves, for example, must be able to withstand a high number of valve impact events and combustion events with minimal wear (e.g., abrasive, adhesive and corrosive wear). This has motivated a shift in materials selection toward materials that offer improved wear resistance relative to the valve seat insert materials that have traditionally been used by the diesel industry.

Another emerging trend in diesel engine development is the use of EGR (exhaust gas recirculation). With EGR, exhaust gas is routed back into the intake air stream to reduce nitric oxide ($NO_x$) content in exhaust emissions. The use of EGR in diesel engines can raise the operating temperatures of valve seat inserts. Accordingly, there is a need for lower cost exhaust valve seat inserts having good hot hardness for use in diesel engines using EGR.

Also, because exhaust gas contains compounds of nitrogen, sulfur, chlorine, and other elements that potentially can form acids, the need for improved corrosion resistance for alloys used in exhaust valve seat insert applications is increased for diesel engines using EGR. Acid can attack valve seat inserts and valves leading to premature engine failure. Earlier attempts to achieve improved corrosion resistance were pursued through the use of martensitic stainless steels. Though these steels provide good corrosion resistance, conventional martensitic stainless steels do not have adequate wear resistance and hot hardness to meet the requirements for valve seat inserts in modern diesel engines.

Cobalt-based valve seat insert alloys are known for their high temperature wear resistance and compressive strength. A major disadvantage of cobalt-based alloys, however, is their relatively high cost. Iron-based VSI materials, on the other hand, typically exhibit a degradation in matrix strength and hardness with increasing temperature, which can result in accelerated wear and/or deformation. Iron-based alloys for use in internal combustion engine valve seats are disclosed in U.S. Pat. Nos. 5,674,449; 4,035,159 and 2,064,155.

Iron-based alloy compositions are disclosed in U.S. Pat. Nos. 6,340,377; 6,214,080; 6,200,688; 6,138,351; 5,949,003; 5,859,376; 5,784,681; 5,462,573; 5,312,475; 4,724,000; 4,546,737; 4,116,684; 2,147,122 and in Japanese Patent Nos. 58-058,254; 57-073,172 and 9-209,095.

There is a need in the art for improved iron-based alloys for valve seat inserts that exhibit adequate hot hardness, high temperature strength and low cost, as well as corrosion and wear resistance suitable for use in exhaust valve insert applications in diesel engines using EGR.

SUMMARY OF THE INVENTION

An iron-based alloy with improved corrosion resistance, hot hardness and/or wear resistance. The alloy is suitable for use in exhaust valve seat insert applications, such as diesel engines using EGR.

According to an embodiment, the iron-based alloy comprises, in weight percent, boron from about 0.005 to about 0.5%; carbon from about 1.2 to 1.8%; vanadium from about 0.7 to 1.5%; chromium from about 7 to 11%; niobium from about 1 to 3.5%; molybdenum from about 6 to 11%, and the balance including iron and incidental impurities.

According to another embodiment, a cast, iron-based tungsten-free alloy comprises, in weight percent, boron from about 0.1 to 0.3%; carbon from about 1.4 to 1.8%; silicon from about 0.7 to 1.3%, vanadium from about 0.8 to 1.5%; chromium from about 9 to 11%; manganese from about 0.2 to 0.7%; cobalt from about 0 to 4%; nickel from about 0 to 2%; niobium from about 1 to 2.5%; molybdenum from about 8 to 10%, and the balance including iron and incidental impurities. If desired, copper can be substituted partially or completely for cobalt.

According to a further embodiment, the alloy comprises about 0.005 to 0.5% boron; about 1.2 to 1.8% carbon; about 0.7 to 1.5% vanadium; about 7 to 11% chromium; about 6 to 11% molybdenum; at least one element selected from the group consisting of titanium, zirconium, niobium, hafnium and tantalum, represented by Ti, Zr, Nb, Hf and Ta, respectively, and the balance including iron and incidental impurities, such that $1\% < (Ti+Zr+Nb+Hf+Ta) < 3.5\%$.

According to a preferred embodiment, the alloy is tungsten-free and includes, in weight percent, up to 1.6% Si and/or up to about 2% Mn. Preferably, the alloy can include between about 0.1 to 0.3% boron; about 1.4 to 1.8% carbon; about 0.8 to 1.5% vanadium; about 9 to 11% chromium; about 1 to 2.5% niobium; up to about 4% cobalt, more preferably about 1.5 to 2.5% cobalt; up to about 2% nickel, more preferably about 0.7 to 1.2% nickel and/or about 8 to 10% molybdenum. According to a preferred embodiment, the content, in weight percent, of boron, vanadium and niobium satisfy the condition $1.9\% < (B+V+Nb) < 4.3\%$ wherein B, V and Nb represent the weight % content of boron, vanadium and niobium, respectively.

Preferably, the alloy is in a hardened and tempered condition and the alloy has a martensitic microstructure including primary and secondary carbides. Preferably, the primary carbides in the alloy have a width smaller than about 10 microns, more preferably smaller than about 5 microns, and the secondary carbides in the alloy are smaller than about 1 micron. The alloy is preferably in the form of a casting. The hardened and tempered alloy preferably exhibits a hardness of at least about 42 Rockwell C. At a temperature of 800° F., the hardened and tempered alloy preferably exhibits a Vickers hot hardness of at least about 475 and compressive yield strength of at least about 100 ksi. The alloy preferably has a dimensional stability of less than about $0.5\times10^{-3}$ inches after 20 hours at 1200° F.

According to a preferred embodiment, the alloy comprises a part for an internal combustion engine such as a valve seat insert for a diesel engine using EGR. The valve seat insert can be in the form of a casting or in the form of a pressed and sintered compact. Alternatively, the alloy can be a coating on the face of a valve seat insert and/or on the face of a valve seat. The alloy can also be used for wear resistant applications such as ball bearings.

According to a preferred method of making a cast alloy, the alloy is cast from a melt at a temperature of from about 2800 to 3000° F., preferably about 2850 to 2925° F. The alloy can be heat treated by heating to a temperature of from about 1550 to 2100° F., quenching and tempering at a temperature of from about 1200 to 1400° F.

BRIEF DESCRIPTION OF THE DRAWINGS

The following detailed description of preferred embodiments makes reference to the accompanying drawing, in which.

DETAILED DESCRIPTION OF THE PREFERRED EMBODIMENT

The present invention relates to an iron-based alloy. The hot hardness, high temperature strength and wear resistance of the alloy make it useful in a variety of high temperature applications. A preferred application for the alloy is in internal combustion engine valve seat inserts. Preferably, the alloy composition is controlled and/or the alloy is processed in a manner which achieves improved hot hardness, improved high temperature compressive strength and/or improved wear resistance for applications such as valve seat inserts. Other applications for the alloy include ball bearings, coatings, and the like.

The alloy preferably comprises, in weight percent, 0.005–0.5% B, 1.2–1.8% C, 0.7–1.5% V, 7–11% Cr, 1–3.5% Nb, 6–11% Mo and the balance including Fe and incidental impurities. The alloy can further comprise up to about 1.6% Si; up to about 2% Mn; up to about 2% nickel, preferably about 0.7–1.2% nickel and/or up to about 4% cobalt, preferably about 1.2–2.5% cobalt. Optionally, Cu may be substituted partially or completely for Co. The alloy can be W-free. For casting applications, the alloy preferably comprises, in weight percent, 0.1–0.3% B, 1.4–1.8% C, 0.7–1.3% Si, 0.8–1.5% V, 9–11% Cr, 0.2–0.7% Mn, 0–4% Co, 0–2% Ni, 1–2.5% Nb, 8–10% Mo and the balance including Fe and incidental impurities.

Figure 1:
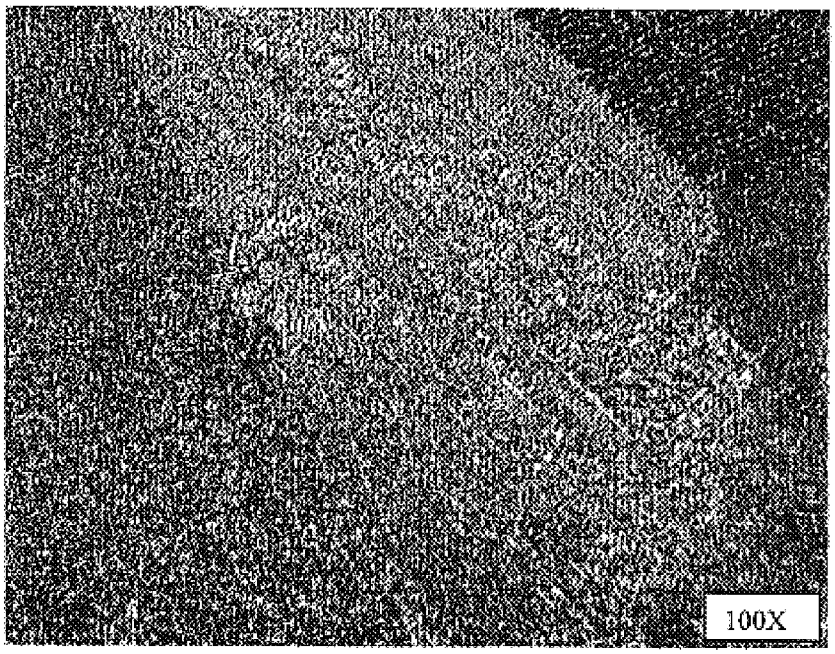
FIGS. 1–2 show optical micrographs of an embodiment of the inventive alloy in the as-cast condition.
Figure 2:
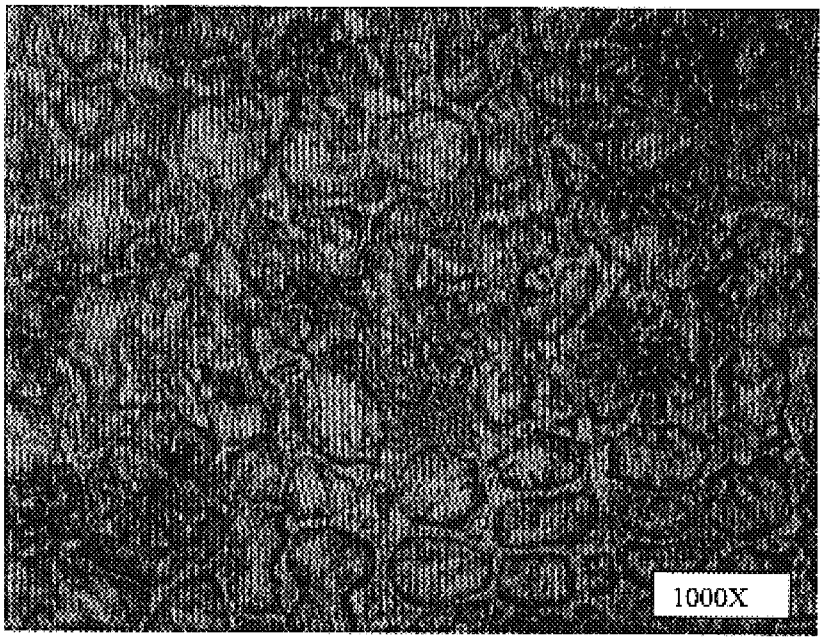
Figure 3:
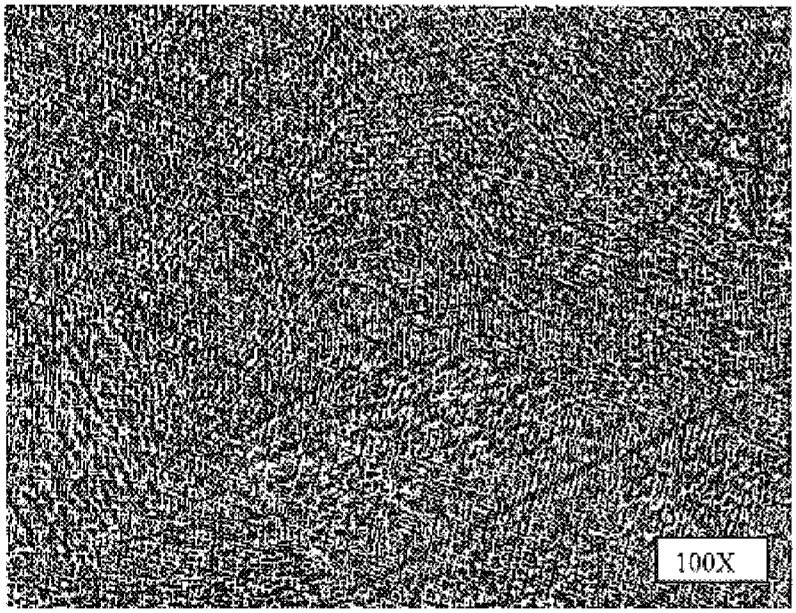
FIGS. 3–4 show optical micrographs of an embodiment of the inventive alloy in the hardened and tempered condition.
Figure 4:
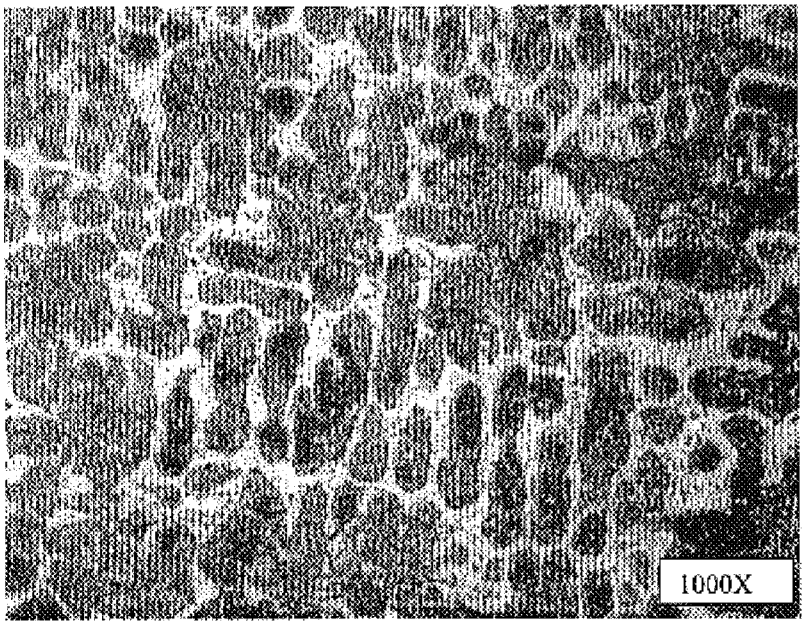

In the as-cast condition the alloy comprises cellular dendritic substructure. In order to achieve corrosion resistance, hot hardness and wear resistance, the alloy preferably is heat treated to obtain a martensitic microstructure that includes primary and secondary carbides. Preferably, in the hardened and tempered condition, the alloy comprises a predominately tempered martensitic microstructure. FIGS. 1–2 show the microstructural morphology of an embodiment of the alloy in the as-cast condition. The as-cast alloy preferably exhibits a fine and uniformly distributed cellular dendritic solidification substructure. FIGS. 3–4 show the microstructural morphology of an embodiment of the alloy in the hardened and tempered condition. The hardening and tempering conditions for the alloy shown in FIGS. 3–4were heating at 1700° F. for 2.5 hours, quenching and heating at 1300° F. for 3.5 hours. After heat treatment, the cellular dendritic region changed to predominately a tempered martensitic microstructure. The martensitic structure is formed during hardening through a solid state phase transformation.

According to a preferred embodiment, the alloy of the present invention can be processed to achieve good wear resistance, good corrosion resistance and good hot hardness in the hardened and tempered condition. The alloy may be processed by conventional techniques including powder metallurgy, casting, thermal/plasma spraying, weld overlay, etc.

The alloy can be formed into a powder material by various techniques including ball milling elemental powders or atomization to form pre-alloyed powder. The powder material can be compacted into a desired shape and sintered. The sintering process can be used to achieve desired properties in the part.

Parts such as valve seat inserts and ball bearings are preferably manufactured by casting, which is a well known process involving melting the alloy constituents and pouring the molten mixture into a mold. Preferably, the cast alloy is subsequently hardened and tempered before machining into a final shape.

In a preferred embodiment, the alloy is used in the manufacture of valve seat inserts including exhaust valve seat inserts for use in diesel engines, e.g., diesel engines with or without EGR. The alloy may find utility in other applications including, but not limited to, valve seat inserts made for gasoline, natural gas or alternatively fueled internal combustion engines. Such valve seat inserts may be manufactured by conventional techniques. In addition, the alloy may find utility in other applications where high temperature properties are advantageous, such as wear resistant coatings, internal combustion engine components and diesel engine components.

The alloy can be heat treated to obtain improved corrosion resistance while maintaining a fine-grained martensitic microstructure that provides excellent wear resistance and hardness, especially at elevated temperatures.

Boron, which has a very low solubility in iron (e.g., about 0.01 wt. %), can be used to achieve a high level of hot hardness. Small amounts of boron can improve strength of the alloy and can improve grain refinement through precipitation hardening (e.g., boron carbides, boron nitrides, boron carbonitrides). The distribution of boron can be both intragranular (within a grain) and intergranular (along grain boundaries). Excessive boron, however, can segregate to grain boundaries and degrade the toughness of the steel. By controlling the addition of boron in conjunction with other alloying additions, intragranular saturation of boron can be achieved which promotes the formation of boron compounds at the grain boundaries. These boron compounds can effectively enhance grain boundary strength. The boron content in the alloy is preferably between from about 0.005 to 0.5%, more preferably between from about 0.1 to 0.3% by weight. Without wishing to be bound by theory, it is believed that boron, both in solid solution and through the formation of boron compounds (e.g., compounds with C, N, Fe, Cr and/or Mo), can advantageously strengthen the steel by solid solution hardening and precipitation hardening preferably along solidification substructural boundaries and pre-austenitic grain boundaries.

The carbon content and chromium content are believed to contribute to the beneficial properties of the alloy. Carbon is preferably present in the alloy in an amount ranging from about 1.2 to 1.8 weight percent; more preferably, between about 1.4 to 1.8 weight percent; and most preferably, between about 1.5 to 1.7 weight percent.

Improved wear resistance properties can be attributed to the microstructure and hardness of the alloy. The chemistry of the alloy (e.g., the carbon concentration) can influence the formation of primary carbides and promote the formation of secondary carbides. A primary carbide typically forms during solidification of the bulk material. In contrast, secondary carbides form after the bulk material solidifies, e.g., during heat treatment. Additional factors such as heat treatment temperatures and quenching/cooling rates can affect the relative formation of primary and secondary carbides. Carbon can form both primary and secondary carbides with B, V, Cr, Nb, Mo and Fe, which can contribute to the strength of the alloy. If present, other elements such as Ti, Zr, Hf, Ta and W can also form carbides with carbon. Preferably, primary carbides in the alloy have a width smaller than about 10 microns, more preferably smaller than about 5 microns. Secondary carbides in the alloy are preferably smaller than about 1 micron.

Chromium is preferably present in the alloy in an amount between about 7 to 11 weight percent; more preferably, between about 9 to 11 weight percent. The chromium content preferably provides a desirable combination of corrosion resistance, hardenability, wear resistance and oxidation resistance. Without wishing to be bound by theory, the chromium in the alloy is believed to form a dense, protective chromium oxide layer on the surface of the alloy that inhibits high temperature oxidation and minimizes wear and corrosion.

Nickel may be present in the alloy in an amount which does not adversely affect the desired properties of the alloy. Nickel can advantageously increase the resistance to oxidation and lead (Pb) corrosion and can also increase the hardness and strength of the alloy via second phase strengthening. Too much nickel, however, enlarges the size of the austenitic region in the iron-chromium-nickel system, which results in an increase in the coefficient of thermal expansion and a decrease in the low temperature wear resistance of the alloy. The alloy preferably has a low coefficient of thermal expansion when used in dimensionally stable parts. For dimensionally stable parts, which are subjected to temperature fluctuations, a large coefficient of thermal expansion is undesirable. Nickel can also increase low temperature wear and add to the cost of the alloy. Thus, the nickel content is preferably limited to less than about 2 weight percent, more preferably between about 0.7 to 1.2 weight percent.

Molybdenum is preferably present in the alloy in an amount ranging from between about 6 to 11 weight percent; more preferably between about 8 to 10 weight percent. Molybdenum is added in an amount effective to promote solid solution hardening of the alloy and provide resistance to creep of the alloy when exposed to elevated temperatures. Molybdenum can also combine with carbon to form primary and secondary carbides.

Cobalt may be added to the alloy to improve hot hardness. Cobalt may be present in the alloy in an amount preferably less than about 4 weight percent, more preferably between about 1.5 to 2.5 weight percent. While cobalt may improve properties such as hot hardness, the addition of cobalt increases cost.

Copper may be present in the alloy in an amount preferably less than about 4 weight percent, more preferably less than about 2 weight percent if no cobalt is employed. Copper may be substituted partially or completely for cobalt. Copper can dissolve in the Fe matrix and improve dimensional stability of the alloy. Too high a copper content, however, e.g., above about 4 weight percent, can reduce the mechanical strength of the alloy.

Niobium may be present in the alloy in an amount preferably ranging from about 1 to 3.5 weight percent; more preferably, between about 1 to 2.5 weight percent. Niobium can form fine secondary carbides in the alloy matrix and at grain boundaries when the alloy solidifies as a casting and/or when the alloy is subjected to heat treatment. The presence of secondary carbides can enhance creep rupture strength at high temperatures.

Vanadium may be present in the alloy in an amount preferably ranging from about 0.7 to 1.5 weight percent; more preferably, about 0.8 to 1.5 weight percent. Like niobium, vanadium can form secondary carbides, which can enhance high temperature wear resistance. Too high a vanadium content, however, can reduce toughness.

Boron, vanadium, chromium, niobium and molybdenum are carbide formers. Primary and secondary carbide phases can form within the iron solid solution matrix and can control grain size and improve the strength of the alloy through precipitation hardening. Vanadium, niobium and molybdenum are preferably added in amounts effective to provide microstructural refinement. For example, it is believed that niobium can provide a fine secondary carbide distribution. According to a preferred embodiment, the content, in weight percent, of the boron, vanadium and niobium satisfy the condition $1.9\% < (B+V+Nb) < 4.3\%$. While boron, vanadium, niobium and molybdenum are preferred, other carbide formers (e.g., titanium, zirconium, hafnium, tantalum and tungsten) can be present in the alloy. According to a further embodiment, the alloy comprises about 0.005 to 0.5% boron; about 1.2 to 1.8% carbon; about 0.7 to 1.5% vanadium; about 7 to 11% chromium; about 6 to 11% molybdenum; at least one element selected from the group consisting of titanium, zirconium, niobium, hafhium and tantalum, represented by Ti, Zr, Nb, Hf and Ta, respectively, and the balance including iron and incidental impurities, such that $1\% < (Ti+Zr+Nb+Hf+Ta) < 3.5\%$.

The amounts of carbon and carbide formers can be adjusted to provide for the formation of carbides in an amount effective to control grain growth in the alloy during exposure of the alloy to high temperatures. The amounts of carbon and carbide formers can be chosen to obtain a stoichiometric or near stoichiometric ratio of carbon to carbide former such that the desired amount of carbon in solid solution can be achieved. An excess of carbide former, however, can be beneficial. Excess niobium, for example, can form a spallation-resistant niobium oxide during high temperature thermal cycling in air.

According to a preferred embodiment, the alloy is tungsten-free. If desired, the alloy can include tungsten to improve the high temperature wear resistance of the alloy. Too much tungsten, however, can embrittle the alloy, degrade castability and/or reduce toughness.

In the case of cast alloys, silicon may be present in an amount up to about 1.6 weight percent, preferably ranging from about 0.7 to 1.6 weight percent, more preferably between about 0.7 to 1.3 weight percent, and manganese may be present in the alloy in an amount up to about 2 weight percent, preferably ranging from about 0.2 to 0.8 weight percent, more preferably between about 0.2 to 0.7 weight percent.

Silicon and manganese can form a solid solution with iron and increase the strength of the alloy through solid solution hardening as well as increase the resistance to oxidation. When the alloy is formed into parts by casting, the addition of silicon and manganese can contribute to de-oxidation and/or degassing of the alloy., Silicon can also improve the castability of the material. The contents of silicon and manganese are preferably limited to less than 1.6 and 0.8 weight percent, respectively, however, in order to reduce embrittlement of the alloy. In the case where the part is not cast, silicon and manganese can be reduced or omitted from the alloy.

The balance of the alloy is preferably iron (Fe) and incidental impurities. The alloy can contain trace amounts (e.g., up to about 0.1 wt. % each) of sulphur, nitrogen, phosphorous and/or oxygen. Other alloy additions that do not adversely affect corrosion, wear and/or hardness properties of the alloy may be added to the alloy.

The Fe-based alloy of the present invention is preferably formed by the arc melting, air induction melting, or vacuum induction melting of powdered and/or solid pieces of the selected alloy constituents at a temperature such as about 2800 to 3000° F., preferably about 2850 to 2925° F. in a suitable crucible, for example, $ZrO_2$. The molten alloy is preferably cast into a mold, e.g., sand, graphite or the like, in the configuration of a desired part.

The as-cast alloy can be heat treated. For example, the as-cast alloy can be heated in a temperature range of about 1550 to 2100° F., preferably about 1550 to 1750° F., for about 2 to 4 hours, quenched in a suitable medium such as air, oil, water or a salt bath and then tempered in a temperature range of about 1200 to 1400° F., preferably about 1200 to 1350° F., for about 2 to 4 hours. The heat treatment can be carried out in an inert, oxidizing or reducing atmosphere (e.g., nitrogen, argon, air or nitrogen-hydrogen mixture), in vacuum or in a salt bath. Preferably, the heat treatment minimizes the amount of retained austenite in the alloy.

Figure 5:
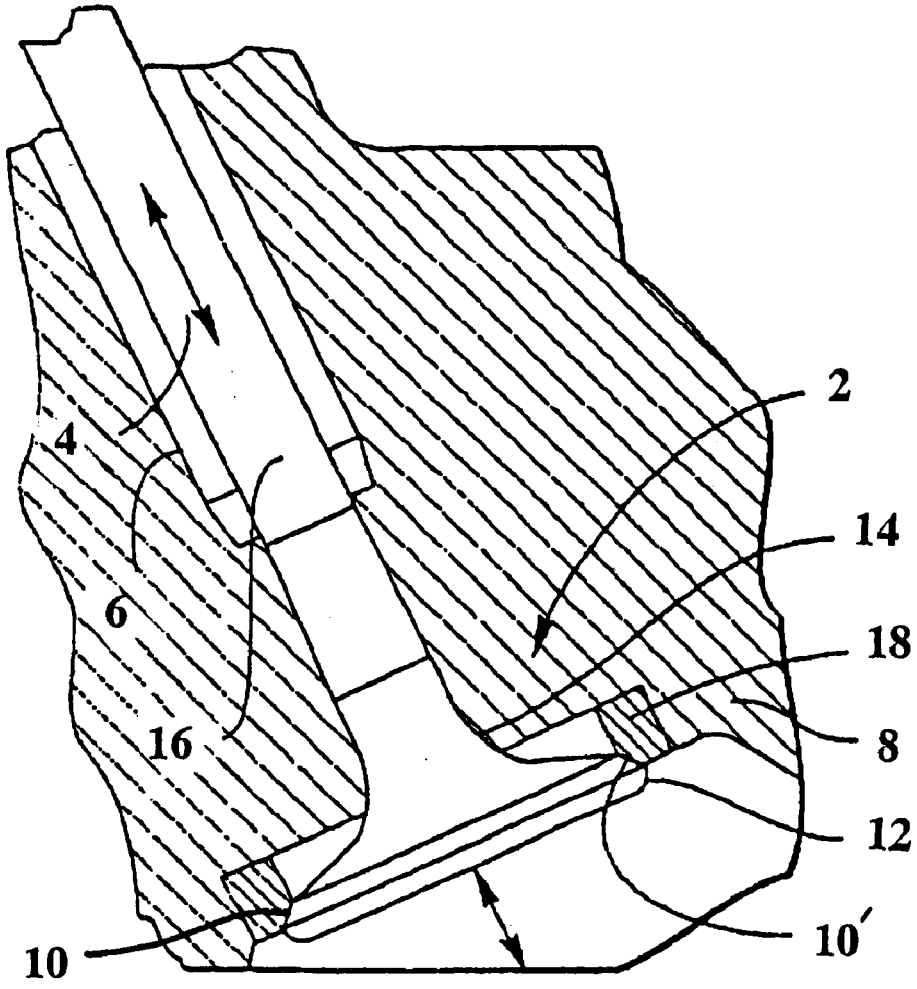
FIG. 5 is a cross-sectional view of a valve assembly.

FIG. 5 shows an exemplary engine valve assembly 2. Valve assembly 2 include a valve 4, which is slideably supported within the internal bore of a valve stem guide 6. The valve stem guide 6 is a tubular structure that fits into the cylinder head 8. Arrows show the direction of motion of the valve 4.

Valve 4 includes a valve seat face 10 interposed between the cap 12 and neck 14 of the valve 4. Valve stem 16 is positioned above neck 14 and is received within valve stem guide 6. A valve seat insert 18 having a valve seat insert face 10' is mounted, such as by press-fitting, within the cylinder head 8 of the engine. The cylinder head usually comprises a casting of cast iron, aluminum or an aluminum alloy. Preferably, the insert 18 (shown in cross section) is annular in shape and the valve seat insert face 10' engages the valve seat face 10 during movement of valve 4.

EXAMPLES

The alloys were cast according to standard foundry techniques with the compositions shown in Table I. The alloys were cast in 50 pound lots (heats) using a standard pour header (¾" diameter) and SiMn (2 oz/100 lb), FeV (3 oz/100 lb) and/or CeLa (1 oz/100 lb) inoculants. Developmental Heat A was cast at 2882° F. In the hardened and tempered condition, the microstructure of Heat A comprised martensite and pearlite. Heat A was hardened at 1600° F. for about 3 hrs., quenched in moving air and tempered at 1200° F. for about 3.5 hrs. In order to improve the oxidation resistance of Heat A, developmental Heat B (poured at 2850° F.) was prepared with reduced C and Mo contents. Heat B also contained B and Nb in order to increase the hardened and tempered hardness. In order to achieve an alloy with better toughness than Heat B, a third alloy, inventive Heat C (poured at 2850° F.) was prepared. Heat C exhibited both improved hardness and improved toughness. Heat C may be characterized as a low B, high Cr, high Mo, Fe-based alloy. Heat C has excellent castability, is heat treatable at a temperature as high as 1850° F. in an oxygen-containing atmosphere (such as air) with an acceptable amount of oxidation, displays good toughness and dimensional stability, and demonstrates favorable wear resistance and hot hardness.

The effect of compositional changes was explored by systematically varying the composition of inventive Heat C in order to produce inventive Heats 1–11. For example, referring to Table I, Heat 2 has a comparatively low C content, while Heat 3 has a comparatively high B content. Properties of the alloys are discussed below. The silicon content in Heat C was not measured.

TABLE I

Composition of Alloys (wt. %)

| Heat | B | C | Si | V | Cr | Mn | Ni | Nb | Mo | Fe |
|---|---|---|---|---|---|---|---|---|---|---|
| A | — | 1.56 | 1.04 | 2.83 | 8.87 | 0.55 | 0.34 | — | 11.74 | 73.07 |
| B | 0.60 | 1.48 | 1.44 | 1.34 | 10.57 | 0.59 | 3.17 | 2.13 | 9.60 | 69.08 |
| C | 0.09 | 1.42 | na | 1.08 | 9.85 | 0.51 | 1.90 | 1.72 | 8.70 | <74.73 |
| 1 | 0.18 | 1.56 | 0.82 | 0.97 | 10.10 | 0.40 | 0.75 | 1.95 | 8.85 | 74.42 |
| 2 | 0.18 | 1.27 | 0.80 | 1.07 | 10.03 | 0.51 | 0.74 | 1.76 | 9.25 | 74.39 |
| 3 | 0.28 | 1.55 | 1.05 | 0.95 | 9.81 | 0.61 | 1.27 | 1.59 | 8.97 | 73.92 |
| 4 | 0.16 | 1.56 | 0.97 | 0.92 | 9.91 | 0.61 | 0.09 | 1.76 | 8.85 | 75.17 |
| 5 | 0.18 | 1.55 | 1.10 | 1.04 | 9.77 | 0.71 | 0.76 | 3.00 | 8.89 | 73.00 |
| 6 | 0.15 | 1.46 | 1.38 | 1.04 | 7.15 | 0.74 | 0.68 | 1.42 | 6.03 | 79.95 |
| 7 | 0.16 | 1.49 | 0.98 | 1.12 | 9.88 | 0.38 | 0.77 | 1.72 | 10.35 | 73.15 |
| 8 | 0.17 | 1.53 | 0.90 | 0.93 | 8.74 | 0.52 | 0.71 | 1.62 | 9.26 | 75.62 |
| 9 | 0.17 | 1.44 | 1.01 | 1.12 | 9.64 | 0.49 | 0.43 | 1.84 | 9.10 | 74.76 |
| 10 | 0.11 | 1.67 | 1.00 | 1.36 | 9.70 | 0.51 | 1.01 | 2.09 | 9.46 | 73.09 |
| 11 | 0.17 | 1.62 | 0.98 | 1.35 | 9.88 | 0.39 | 1.10 | 1.91 | 9.35 | 73.25 |

na = not available

Table II compares the compositions of the alloy of the invention (collectively J130) with other steels including J125 (a cast martensitic stainless steel), J120V (a cast high-speed molybdenum tool steel) and J3 (a cast cobalt-based alloy), each available from L. E. Jones Co., the assignee of the present application.

TABLE II

Comparative Alloy Compositions

| | J130 | J125 | J120V | J3 |
|---|---|---|---|---|
| B | 0–0.5 | — | — | — |
| C | 1.25–1.75 | 1.35–1.75 | 1.20–1.50 | 2.25–2.60 |
| Si | 0.7–1.6 | 1.9–2.6 | 0.3–0.6 | 0.4–1.0 |
| V | 0.7–1.5 | — | — | — |
| Cr | 7–11 | 19.0–21.0 | 3.50–4.25 | 29.0–32.0 |
| Mn | 0.2–0.8 | 0.2–0.6 | 0.3–0.6 | 0–1.0 |
| Co | 0–4 | — | — | 43.40–57.35 |
| Ni | 0–2 | 1.0–1.6 | 0–1.0 | 0–3.0 |

TABLE II-continued

| | Comparative Alloy Compositions | | | |
|---|---|---|---|---|
| | J130 | J125 | J120V | J3 |
| Nb | 1–3.25 | — | — | — |
| Mo | 6–11 | — | 6.0–7.0 | — |
| W | — | — | 5.0–6.0 | 11.0–14.0 |
| Fe | 63–83 | 72–77 | 79–84 | 0–3.0 |

The microhardness and bulk hardness of the alloy having the compositions shown in Table I were tested in the as-cast, as-hardened and hardened and tempered conditions. For Heat A, the hardening and tempering temperatures were 1600° F. and 1200° F., respectively. Heat B was hardened over the temperature range of 1600 to 1750° F., and tempered at about 1350° F. For Heat C, the hardening and tempering temperatures were 1750° F. and 1350° F., respectively. Heats 1–11 were heated at about 1550° F., quenched in air, and tempered at 1350° F. The heating atmosphere for Heats A–C and 1–11 was air. Hardness results are summarized in Table III. As shown, in the hardened and tempered condition, Heat 2, which contained the least amount of carbon, had the lowest microhardness while Heat 3, which contained the highest boron content, had the highest microhardness.

The effect of boron on hardenability is shown in Table IV. Average bulk hardness results are shown for a series of samples in the as-cast, hardened and hardened and tempered conditions. In addition to boron, which was varied according to the values shown in Table III, the samples had the following nominal compositions, in weight percent: 1.6% C, 1% Si, 1.3% V, 9.75% Cr, 0.45% Mn, 1% Ni, 1.9% Nb, 9% Mo and the balance including Fe and incidental impurities. Each of the heats was poured at a temperature of about 2865° F. to 2885° F. with 0.5 oz of SiMn and 0.5 oz of FeV inoculation. The samples were hardened at 1700° F. and tempered at 1300° F. The data in Table IV show that the hardenability and hardness of the J130 alloy is a function of the boron content.

TABLE II

| | Microhardness (HK 0.5) | | | Bulk Hardness ($R_c$) | | |
|---|---|---|---|---|---|---|
| Heat | as-cast | as-hardened | hardened & tempered | as-cast | as-hardened | hardened & tempered |
| A | | | | | | 45 |
| B | | | | 53 | 59–65 | 53 |
| C | | | | 53 | 61 | 50 |
| 1 | 559 | 690 | 500 | | 58.2 | 45.9 |
| 2 | 491 | 604 | 438 | | 54.3 | 41.8 |
| 3 | 499 | 748 | 519 | | 60.1 | 48.4 |
| 4 | 547 | 660 | 480 | | 54.7 | 46.1 |
| 5 | 457 | 689 | 504 | | 57.8 | 46.6 |
| 6 | 594 | 610 | 498 | | 58.0 | 43.6 |
| 7 | 500 | 644 | 497 | | 56.5 | 45.2 |
| 8 | 439 | 581 | 499 | | 59.1 | 46.1 |
| 9 | 608 | 595 | 447 | | 53.4 | 42.3 |
| 10 | | | | | | 46–49 |
| 11 | | | | | | 46–49 |

TABLE IV

| | Effect of Boron Content on Bulk Hardness | | | |
|---|---|---|---|---|
| | Nominal Boron | Bulk Hardness ($R_c$) | | |
| Heat | Content (wt. %) | as-cast | as-hardened | hardened & tempered |
| AA | 0 | 44.7 | 58.2 | 44.0 |
| BB | 0.05 | 45.9 | 61.7 | 47.1 |
| CC | 0.15 | 46.7 | 61.5 | 48.2 |
| DD | 0.25 | 51.5 | 61.2 | 49.8 |
| EE | 0.35 | 58.0 | 62.5 | 49.6 |
| FF | 0.45 | 61.6 | 60.5 | 51.4 |

The alloys tested exhibited excellent hot hardness with values that are comparable to or exceed those of tool steel at all elevated temperature levels tested. Referring to ASTM Standard Test Method E92-72, hot hardness measurements were taken at various temperature increments after holding an alloy sample from Heat 8 under argon at temperature for 30 minutes. The hardness was measured using a pyramid indenter having a Vickers diamond face angle of 136 degrees and a load of 10 kg, making at least three indentations per sample. The average hot hardness results at the various temperatures are shown in Table V along with comparative data for J125, J120V and J3.

TABLE V

| | Hot Hardness Properties Reported in Vicker's Hardness | | | |
|---|---|---|---|---|
| | Alloy | | | |
| Test Temperature (° F.) | Heat 8 | J125 | J120V | J3 |
| 32 | 580 | 397 | 536 | 719 |
| 200 | 569 | 389 | 530 | 702 |
| 400 | 568 | 358 | 493 | 643 |
| 600 | 530 | 344 | 465 | 600 |
| 800 | 492 | 306 | 416 | 555 |
| 1000 | 445 | 215 | 344 | 532 |
| 1200 | 373 | 119 | 209 | 483 |
| 1400 | 240 | 47 | 104 | 389 |
| 1600 | 134 | 58 | 103 | 221 |

As shown in Table V, the Heat 8 alloy displays a hot hardness greater than the J125 and J120V steels, and comparable with the J3 cobalt-based alloy, temperature range measured.

VI–VIII compare room temperature and high temperature properties of the Heat 1 alloy to the J125, J120V and J3 materials.

Compressive Yield Strength

Compression testing was performed by Westmoreland Mechanical Testing & Research (Youngstown, Pa.). Compressive yield strength data is shown in Table VI.

TABLE VI

| | Compressive Yield Strength (0.2% offset) (ksi) | | | |
|---|---|---|---|---|
| | Alloy | | | |
| Temperature (° F.) | Heat 1 | J125 | J120V | J3 |
| 70 | 159 | 145 | 149 | 135 |
| 600 | 148 | 119 | 125 | 113 |

TABLE VI-continued

| Compressive Yield Strength (0.2% offset) (ksi) | | | | |
|---|---|---|---|---|
| | Alloy | | | |
| Temperature (° F.) | Heat 1 | J125 | J120V | J3 |
| 800 | 125 | 105 | 111 | 99 |
| 1000 | 105 | 71 | 104 | 99 |

Hot Corrosion Resistance

Traditionally, cobalt-based alloys exhibit very good corrosion resistance. The J3 alloy, for example, displays excellent corrosion resistance. Also, the J125 alloy displays corrosion resistance comparable to the Co-based alloys. The sulfidation test involves exposing a test specimen (0.5 inch diameter×0.5 inch long ) to a mixture of 10 parts $CaSO_4$, 6 parts $BaSO_4$, 2 parts $Na_2SO_4$, 2 parts NaCl and 1 part graphite. Weight loss is measured as a function of time for samples immersed in the above mixture at 815° C. The normalized weight loss (weight loss per unit surface area of the sample before testing) for 10, 50 and 100 hour tests for Heart 8 was about 0.2, 0.9 and 2.3 mg/mm$^2$, respectively. The J130 alloy, as represent by Heat 8, compares favorably with other iron-based materials.

Wear Testing

Monomotion wear tests were performed on a pin-on-disk wear test fixture at room temperature for 3 hours. The monomotion wear test simulates the sliding wear mechanisms in VSI applications. Monomotion wear testing is conducted using a ⅜" wide stationary plate of the alloy on a ½" diameter rotating cylinder made of Sil 1 material. The test speed is 1725 rpm. Plate material loss (Heat 8, J125 and J120V material) and total material loss (plate+cylinder), expressed as weight loss in milligrams, are summarized in Table VII as a function of different applied loads.

TABLE VII

| Monomotion Wear Test (mg) | | | | | | |
|---|---|---|---|---|---|---|
| | Heat 8 | | J125 | | J120V | |
| load (lb.) | plate | total | plate | total | plate | total |
| 4.5 | 5.7 | 45.7 | 6.8 | 48.4 | 16.0 | 77.9 |
| 9.0 | 11.0 | 49.7 | 60.9 | 123.6 | 14.1 | 68.0 |
| 13.5 | 15.7 | 75.8 | 76.9 | 99.4 | 21.7 | 72.5 |

The wear results show that the Heat 8 alloy has improved wear resistance relative to stainless steels like J125, which are traditionally employed in the diesel industry.

Dimensional Stability

The dimensional stability of multiple samples from heats C and 1–9 were tested using dimensional stability test conditions (1200° F., 20 hrs. aging). Heats 1–9 were in the hardened and tempered condition (hardened at 1550° F., quenched in moving air and tempered at 1350° F.). Averaged dimensional stability test results, expressed in thousandhs of an inch, are shown in Table VIII.

Table VIII

| Dimensionality Stability | |
|---|---|
| Heat | Average OD change (inches) (x10$^{-3}$) |
| C | 0.03 |
| 1 | 0.09 |
| 2 | 0.04 |
| 3 | 0.02 |
| 4 | 0.07 |
| 5 | 0.08 |
| 6 | 0.21 |
| 7 | 0.04 |
| 8 | 0.02 |
| 9 | 0.01 |

Referring to Table VIII, each of the alloys from Heats 1–9 passed the dimensionality test criterion (maximum dimensional change less than 0.0005 inch). The dimensional stability test ensures that thermal cycling does not cause an unacceptable dimensional change in the part, such as through a metallurgical phase change. Only Heat 6 (high Si, low Cr+Mo) had a dimensional change greater than 0.0001 inch.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. An iron-based alloy having a martensitic microstructure including primary and secondary carbides comprising, in weight percent:

boron from about 0.005 to 0.5%; carbon from about 1.2 to 1.8%; vanadium from about 0.7 to 1.5%; chromium from about 7 to 11%; niobium from about 1 to 3.5%; molybdenum from about 6 to 11%, and the balance including iron and incidental impurities.

2. The iron-based alloy of claim 1, wherein the alloy is tungsten-free.

3. The iron-based alloy of claim 1, further comprising between up to about 1.6% Si and/or up to about 2% Mn.

4. The iron-based alloy of claim 1, wherein the boron content is between about 0. 1 to 0.3%.

5. The iron-based alloy of claim 1, wherein the carbon content is between about 1.4 to 1.8%.

6. The iron-based alloy of claim 1, wherein the vanadium content is between about 0.8 to 1%.

7. The iron-based alloy of claim 1, wherein the chromium content is between about 9 to 11%.

8. The iron-based alloy of claim 1, wherein the niobium content is between about 1 to 2.5%.

9. The iron-based alloy of claim 1, further comprising up to about 2% nickel.

10. The iron-based alloy of claim 1, further comprising between about 0.7 to 1.2% nickel.

11. The iron-based alloy of claim 1, wherein the molybdenum content is between about 8 to 10%.

12. The iron-based alloy of claim 1, further comprising up to about 4% cobalt.

13. The iron-based alloy of claim 1, further comprising between about 1.5 to 2.5% cobalt.

14. The iron-based alloy of claim 12, wherein copper is substituted partially or completely for cobalt.

15. The iron-based alloy of claim 1, wherein the contents, in weight percent, of the boron, vanadium and niobium are represented by B, V and Nb, respectively, and satisfy the following condition: 1.9%<(B+V+Nb)<4.3%.

16. The iron-based alloy of claim 1, wherein the alloy is in a hardened and tempered condition.

17. The iron-based alloy of claim 16, wherein the primary carbides have a width smaller than about 10 microns and the secondary carbides are smaller than about 1 micron.

18. The iron-based alloy of claim 1, wherein the alloy is in the form of a casting.

19. The iron-based alloy of claim 1, wherein the alloy is in a hardened and tempered condition having a hardness of at least about 42 Rockwell C.

20. The iron-based alloy of claim 1, wherein the alloy is in a hardened and tempered condition and exhibits a Vickers hot hardness at a temperature of 800° F. of at least about 475.

21. The iron-based alloy of claim 1, wherein the alloy is in a hardened and tempered condition and exhibits a high temperature compressive yield strength at 800° F. of at least about 100 ksi.

22. The iron-based alloy of claim 1, wherein the alloy exhibits a dimensional stability of less than about $0.5\times10^{-3}$ inches after 20 hours at 1200° F.

23. A part for an internal combustion engine comprising the iron-based alloy of claim 1.

24. A valve seat insert comprising the iron-based alloy of claim 1.

25. A valve seat insert for a diesel engine comprising the iron-based alloy of claim 1.

26. A valve seat insert for a diesel engine using EGR comprising the iron-based alloy of claim 1.

27. A valve seat insert comprising the iron-based alloy of claim 1, wherein the valve seat insert is in the form of a casting.

28. A valve seat insert comprising the iron-based alloy of claim 1, wherein the valve seat insert is in the form of a pressed and sintered compact.

29. A valve seat insert having a coating of the iron-based alloy of claim 1.

30. A valve seat insert comprising the iron-based alloy of claim 1 having a Vickers hardness of at least about 475 and a compressive of at least about 100 ksi at a temperature of 800° F.

31. A ball bearing comprising the alloy of claim 1.

32. A cast iron-based tungsten-free alloy having a martensitic microstructure including primary and secondary carbides comprising, in weight percent:

boron from about 0.1 to 0.3%; carbon from about 1.4 to 1.8%; silicon from about 0.7 to 1.3%, vanadium from about 0.8 to 1.5%; chromium from about 9 to 11%; manganese from about 0.2 to 0.7%; cobalt from about 0 to 4%; nickel from about 0 to 2%; niobium from about 1 to 2.5%; molybdenum from about 8 to 10%, and the balance including iron and incidental impurities.

33. A method of making an iron-based alloy comprising. in weight percent:

boron from about 0.005 to 0.5%; carbon from about 1.2 to 1.8%; vanadium from about 0.7 to 1.5%; chromium from about 7 to 11%; niobium from about 1 to 3.5%; molybdenum from about 6 to 11%, and the balance including iron and incidental impurities, wherein the alloy is cast from a melt at a temperature of from about 2800 to 3000° F.

34. The method of claim 33, wherein the alloy is cast from a melt at a temperature of from about 2850 to 2925° F.

35. A method of making an iron-based alloy comprising. in weight percent:

boron from about 0.005 to 0.5%; carbon from about 1.2 to 1.8%; vanadium from about 0.7 to 1.5%; chromium from about 7 to 11%; niobium from about 1 to 3.5%; molybdenum from about 6 to 11%, and the balance including iron and incidental impurities, wherein the alloy is heated at a temperature of from about 1550 to 2100° F., quenched and tempered at a temperature of from about 1200 to 1400° F.

36. An iron-based alloy having a martensitic microstructure including primary and secondary carbides comprising, in weight percent:

about 0.005 to 0.5% boron; about 1.2 to 1.8% carbon; about 0.7 to 1.5% vanadium; about 7 to 11% chromium; about 6 to 11% molybdenum; at least one element selected from the group consisting of titanium, zirconium, niobium, hafnium and tantalum, represented by Ti, Zr, Nb, Hf and Ta, respectively, and the balance including iron and incidental impurities, such that 1%<(Ti+Zr+Nb+Hf+Ta)<3.5%.

* * * * *